US005864993A

United States Patent [19]

Wells

[11] Patent Number: 5,864,993

[45] Date of Patent: Feb. 2, 1999

[54] STABILIZER FOR GROUND STAKE

[76] Inventor: Raymond Wells, P.O. Box 257, Mayo, Fla. 32066

[21] Appl. No.: 841,340

[22] Filed: Apr. 30, 1997

Related U.S. Application Data

[63] Continuation of Ser. No. 693,025, Aug. 6, 1996, abandoned.

[51] Int. Cl.[6] ..... E02D 5/80

[52] U.S. Cl. ..... 52/155; 52/158; 52/165

[58] Field of Search ..... 52/147, 153, 154, 52/155, 156, 157, 158, 162, 165, 166

[56] References Cited

U.S. PATENT DOCUMENTS

| | | | |
|---|---|---|---|
| D. 32,404 | 3/1900 | Gladney | 52/153 X |
| 213,932 | 4/1879 | Powell | 52/155 |
| 314,367 | 3/1885 | Cook | 52/148 |
| 344,683 | 6/1886 | Sherer . | |
| 369,779 | 9/1887 | Davy | 52/155 |
| 425,869 | 4/1890 | Dunham | 52/158 X |
| 575,374 | 1/1897 | Reck | 52/156 X |
| 613,316 | 11/1898 | Robbins | 52/162 |
| 841,812 | 1/1907 | Pement | 52/157 |
| 1,276,853 | 8/1918 | Anderson . | |
| 1,422,301 | 7/1922 | Parker | 52/165 |
| 1,993,049 | 3/1935 | Austin | 52/165 |
| 3,139,163 | 6/1964 | Haller . | |
| 3,754,360 | 8/1973 | Herr | 52/155 X |
| 4,593,500 | 6/1986 | Watson | 52/162 |
| 4,598,512 | 7/1986 | Chapman | 52/165 |
| 5,058,337 | 10/1991 | O'Connor . | |
| 5,295,336 | 3/1994 | Egaas . | |
| 5,428,927 | 7/1995 | Webb et al. . | |
| 5,542,210 | 8/1996 | Hupfl | 47/47 |

FOREIGN PATENT DOCUMENTS

| | | | |
|---|---|---|---|
| 491032 | 3/1953 | Canada | 52/157 |
| 23178 | 6/1918 | Denmark | 52/155 |
| 216139 | 11/1909 | Germany | 52/155 |

*Primary Examiner*—Carl D. Friedman
*Assistant Examiner*—Laura A. Callo
*Attorney, Agent, or Firm*—Terrance L. Siemens

[57] ABSTRACT

An auxiliary stake or stabilizer for reinforcing a rod turned into the ground and placed under tension from a guy wire. The stabilizer has a flattened body characterized by a partially circular groove extending longitudinally along the body. The groove engages the rod and prevents the stabilizer from being displaced from parallel orientation to the rod while the stabilizer is being driven into the ground. The groove is preferably partially circular, for cooperating with rods having circular cross section. The stabilizer has a broadened head for receiving impacts and driving forces, and a tapered distal end for readily penetrating the ground. A preferred material is recycled plastic, which is substantially impervious to natural deterioration.

2 Claims, 2 Drawing Sheets

STABILIZER FOR GROUND STAKE

This application is a continuation of Ser. No. 05/693,025, filed Aug. 6, 1996 abandoned.

BACKGROUND OF THE INVENTION

1. FIELD OF THE INVENTION

The present invention relates to stakes forced into the ground for supporting guy wires and like objects. More particularly, the invention comprises an auxiliary device intended to be driven into the ground to stabilize a rod employed as a stake. The auxiliary device presents a broad face to the ground so that continuous tension applied to the stake does not cause the stake to loosen or to migrate through the ground, thereby relaxing the tension.

The invention comprises a flattened stake having much greater width than thickness. Thickness is sufficient to resist forces arising from tension on the stake. Width causes the auxiliary device or stake to engage a relatively large area of the ground in order to oppose displacement by the stake under tension. A longitudinal groove enables close cooperation with the rod shaped stake with which the novel device is employed.

2. DESCRIPTION OF THE PRIOR ART

Many structures are maintained erect or secured in a desired location or position by guy wires. Guy wires or similar tethers are anchored in the ground by suitable devices. In the case wherein rods are employed in the capacity of stakes to which a guy wire is tied or otherwise fastened, it is possible that over time, the stake will fail to maintain adequate tension on the guy wire.

In some cases, the stake moves through the ground or migrates, eventually becoming so poorly retained within soil that the guy wire is ineffective. Tension applied to the guy wire may have this effect if the installation is not suitably reinforced. This is a known problem which the prior art has addressed primarily by ground anchors.

Ground anchors typically cooperate with a stake, post, or similar structural element driven into the ground. An example is seen in U.S. Pat. No. 344,683, issued to Samuel B. Sherer on Jun. 29, 1886. This invention comprises a primary stake having a channel formed therein for receiving a secondary or auxiliary stake. The secondary stake has a broadened head for receiving driving pressure or impacts, and is curved so as to diverge from the primary stake after its distal end emerges from the channel. The Sherer invention requires close cooperation between primary and secondary stakes. No such cooperation is required in the present invention. Whereas Sherer's secondary stake passes through two openings formed in the primary stake, the auxiliary stake of the present invention contacts, but does not pass through its corresponding primary stake. There is no groove formed in the primary stake in the present invention. And unlike the curved secondary stake of the Sherer invention, the auxiliary stake of the present invention is straight.

Ground anchors are shown in U.S. Pat. Nos. 1,276,853, issued to Brooke Anderson on Aug. 27, 1918, 5,058,337, issued to Michael P. O'Connor on Oct. 22, 1991, and 5,428,927, issued to Leamon Webb et al. on Jul. 4, 1995. In this latter group, the ground anchor comprises an attachment which must be specially connected to its associated stake or post. The ground anchor includes cooperating structure enabling special connection. By contrast, the auxiliary stake of the present invention has only a longitudinal groove for cooperation with its associated stake, not requiring intricate interfitting cooperation or fasteners. Although the device of Anderson has a longitudinal groove, the overall configuration is V-shaped when considered in top plan view. By contrast, the present invention is essentially rectangular, except for the groove. In a further departure from this latter group of patents, the auxiliary stake has a broadened head for receiving pressure or impacts.

None of the above inventions and patents, taken either singly or in combination, is seen to describe the instant invention as claimed.

SUMMARY OF THE INVENTION

The present invention provides a stabilizer which is intended to cooperate with an augered rod turned into the ground as a ground anchor to support a guy wire, and which must be reinforced against displacement due to tension from the guy wire. The novel stabilizer is driven into the ground in abutment with the rod after the rod has been turned into the ground. It is also possible that a guy wire has been fastened to the rod and placed under tension prior to the stabilizer being installed. Therefore, the stabilizer may be installed after the rod is installed.

Unlike a number of prior art devices, no attachment of the stabilizer with the rod is required. Also, no effort need be made to drive both rod and stabilizer into the ground simultaneously, nor effort need be exerted to synchronize penetration of these two devices.

The stabilizer has a flattened body presenting a broad front face oriented perpendicularly to the direction of tension. The rear face of the stabilizer is also broad, since the stabilizer is essentially rectangular when considered in top plan view, except for a longitudinal groove.

This groove is semicircular, or partially circular. The groove engages the rod and has the effect of maintaining the stabilizer parallel to the rod. This feature prevents the stabilizer from progressively diverging from parallel relation to the rod being reinforced when the stabilizer is being driven into the ground. Since the stabilizer is concealed within the ground, divergence could occur without being detected. Even if detected, labor of reinstalling the stabilizer would wastefully duplicate the earlier effort.

The stabilizer has a broadened head for receiving impacts or other driving force. When this head is driven into or flush with the ground, the stabilizer is installed sufficiently deep. Thus the broadened head also serves as an indicator indicating appropriate depth of the stabilizer in the ground.

The stabilizer is preferably fabricated from synthetic resin, or plastic material. Plastic material is lightweight, and impervious to deterioration from natural causes, such as infestation by vermin, chemical attack, saturation by water, and the like, while possessing sufficient strength as to perform its function. By contrast, wooden shims or wedges conventionally employed for this purpose can deform responsive to continuous pressure under tension from the guy wire. Plastic will not enable termite tunnels to bond to external surfaces. Plastic resists shrinking and swelling, particularly if immersed in water. Plastic will not rust or freeze, thereby making subsequent adjustments impossible.

Plastic has the further properties of being susceptible to fabrication by economical methods so as to avoid potentially injurious sharp edges, unlike steel. Also, plastic resists forming sharp chips when being driven by impact. Plastic is lighter than steel, so that bulk shipments are easier to transport and maneuver.

The stabilizer is readily molded from recycled plastics, and requires no fasteners or other components for successful deployment. Construction from recycled plastic material also provides ecologically sound disposal of plastic material. The stabilizer is a full bearing device, which signifies that it will operate at its rated capacity for a prolonged period of time. The stabilizer will secure the rod against loosening and displacement responsive to guy wire tension, and can withstand forces of many wind storms.

Accordingly, it is a principal object of the invention to provide a stabilizer suitable for preventing displacement within the ground of a rod under tension from a guy wire.

It is another object of the invention to enable installation of the rod in the ground prior to installation of the stabilizer.

It is a further object of the invention to promote parallel alignment of the stabilizer with its associated rod even as the stabilizer is driven into the ground and is concealed thereby.

Still another object of the invention is to provide a broadened head for receiving impacts and driving forces.

An additional object of the invention is to promote usage of recycled plastic materials.

It is again an object of the invention to avoid fasteners and other special cooperation with a rod being reinforced.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
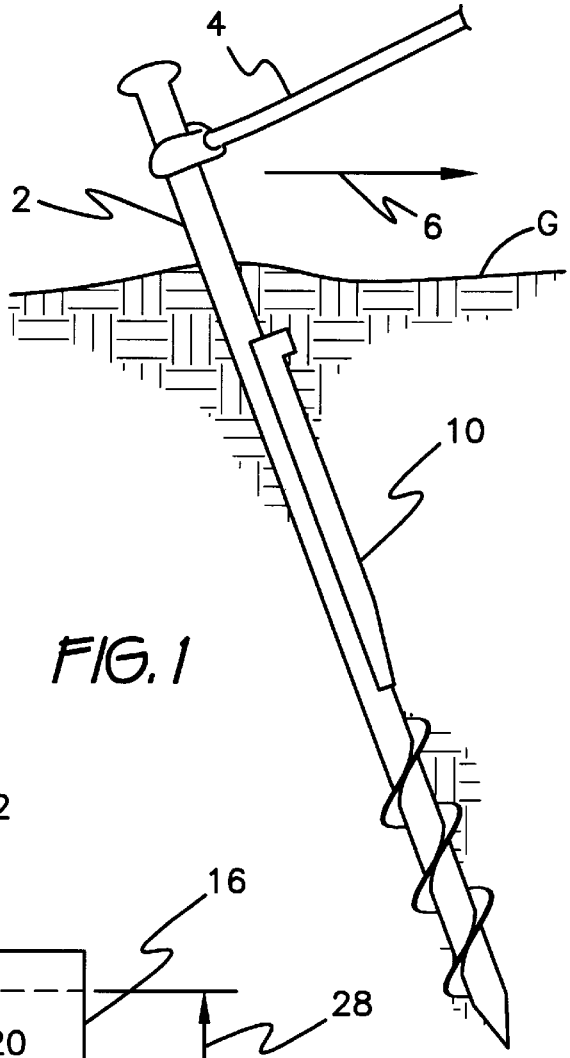
FIG. 1 is a side elevational, partly cross sectional view of the invention.

Turning now to FIG. 1 of the drawings, novel stabilizer 10 is shown stabilizing a,/rod 2 turned into the ground G. Rod 2 is placed under tension by attachment to a guy wire 4 connected to a structure (not shown) which is to be immobilized and supported relative to the ground G. Stabilization will be understood to refer to opposing displacement of rod 2 in the direction indicated by arrow 6. Tightening of guy wire 4 results in a pulling force acting in the direction of arrow 6.

The depiction of FIG. 1 is representative in that guy wire 4 is shown tied to rod 2. Function of stabilizer 10 is identical even if guy wire 4 were attached by a mechanical entrapment to a device forming part of an anchor assembly (not shown), rather than merely being tied to rod 2. Stabilizer 10 is shown in FIG. 1 in a representative final position after initial installation. It is possible that over time, stabilizer 10 may require adjustment by being driven further into the ground G.

Figure 2:
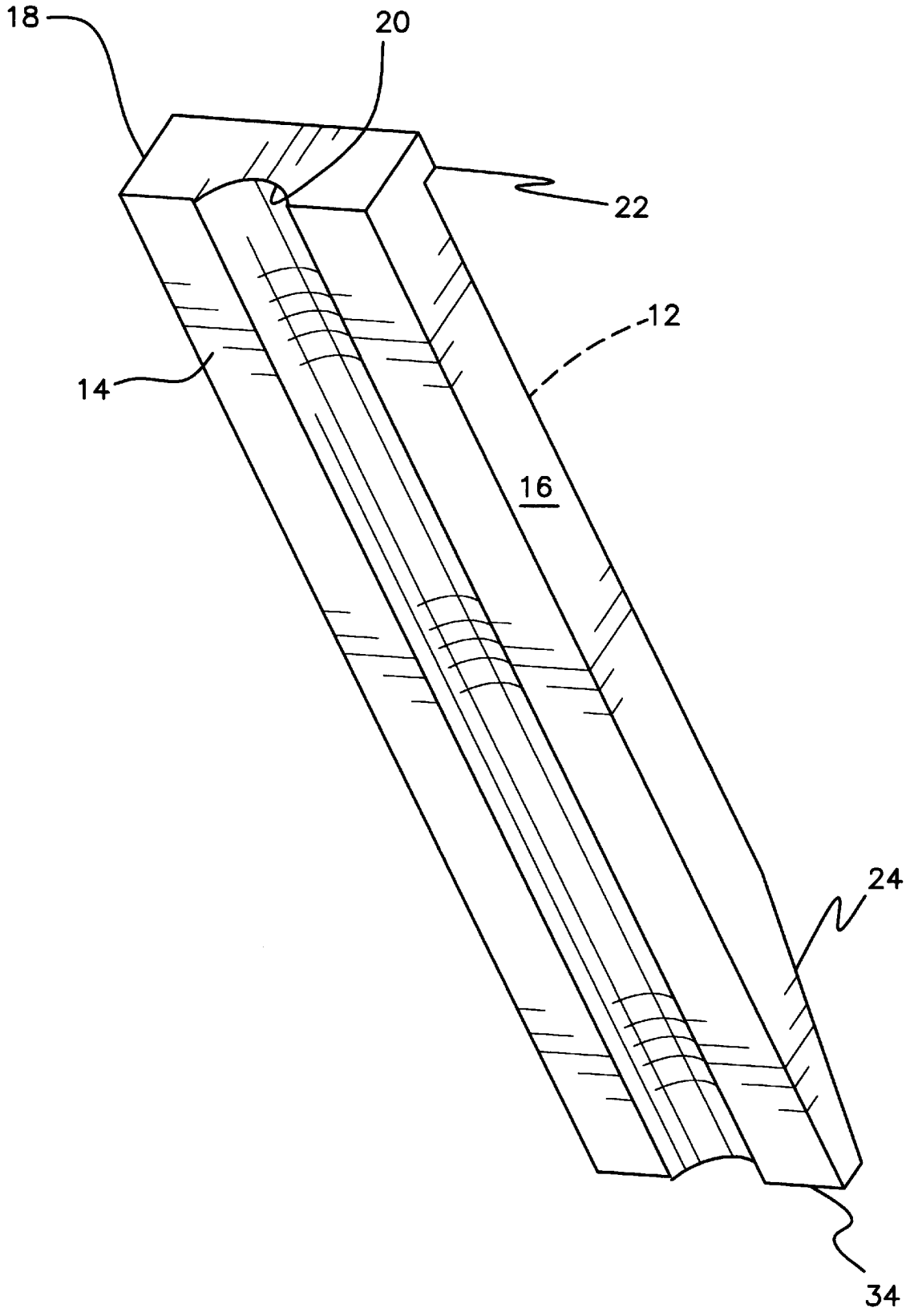
FIG. 2 is a perspective view of the invention.

Construction of stabilizer 10 is better seen in FIG. 2 as generally comprising a flattened, elongated body. This body has a broad front face 12, a broad rear face 14, and right and left lateral faces 16 and 18. Front and rear faces 12, 14 are preferably disposed parallel to one another, so that stabilizer 10 avoids lateral displacement when acted upon by rod 2 placed under tension from guy wire 4. If front and rear faces 12, 14 were not parallel, then a wedging action urging stabilizer 10 laterally to the right or left could ensue, thereby displacing stabilizer 10 from a position centered on rod 2.

A longitudinally oriented, partially circular groove 20 is recessed into rear face 14. Groove 20 is preferably centered between faces 16 and 18. When securing rod 2, rod 2 is placed in abutment with groove 20. Stabilizer 10 is maintained in solid contact with rod 2 by this abutment, and resists being urged to the right or left both during installation and also after installation. The partially circular configuration of groove 20 also accommodates subsequent turning of rod 2, if required to modify depth of rod 2 in the ground, in that rod 2 may be turned with stabilizer 10 abutting rod 2. Stabilizer 10 need not be removed to turn rod 2 for this adjustment.

FIG. 2 also illustrates broadened head created by provision of a flange 22 at the upper end of stabilizer 10. This broadened head enables easy engagement by equipment (not shown) for driving stabilizer 10 into the ground. Flange 22 projects forwardly from stabilizer 10 to avoid interference with groove 20. Flange 22 assists in resisting longitudinal splitting of stabilizer 10 under the influence of driving impacts, where impacts are utilized to drive stabilizer 10 into the ground.

Examination of the lower end of stabilizer 10 will reveal a tapered surface 24. Tapering reduces cross sectional area at the lower end of stabilizer 10, so that stabilizer 10 is easily driven into the ground. It should be noted from the Figure that the terminal end 34 does not come to a point but is flattened or planar. Tapered surface 24 is located at the front of stabilizer 10 in order to cause a wedging action urging stabilizer 10 into close abutment with rod 2 when being driven into the ground.

Figure 3:
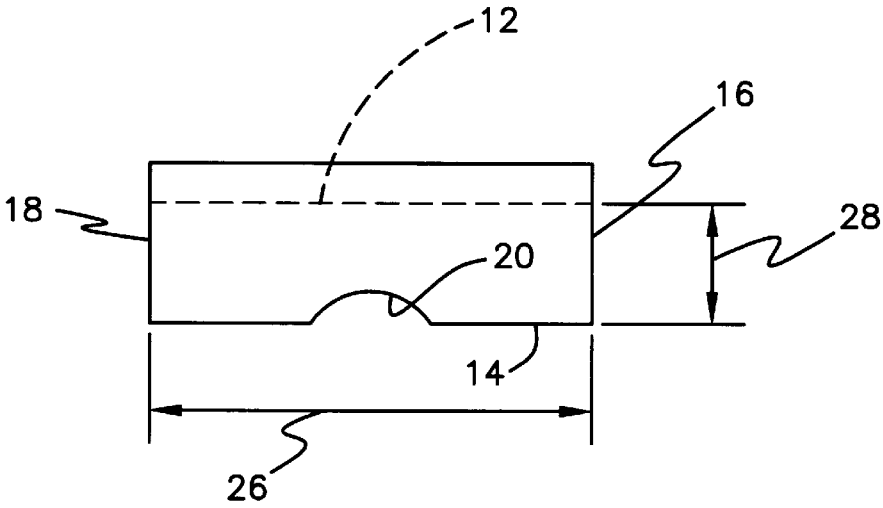
FIG. 3 is a top plan view of the invention.

Turning now to FIG. 3, the flattened nature of stabilizer 10 is emphasized in that width 26 of front and rear faces 12, 14 is significantly greater in magnitude than thickness 28 of stabilizer 10. Also, rear face 14 is seen to be flat, in the sense of being planar. FIG. 3 further emphasizes 3 that groove 20 projects entirely to the interior of the body of stabilizer 10 with respect to every part of rear face 14. And as seen in FIGS. 1 and 2, groove 20 extends the entire length of the body and is of equal depth relative to projection to the interior of the body along the entire length of groove 20.

Figure 4:
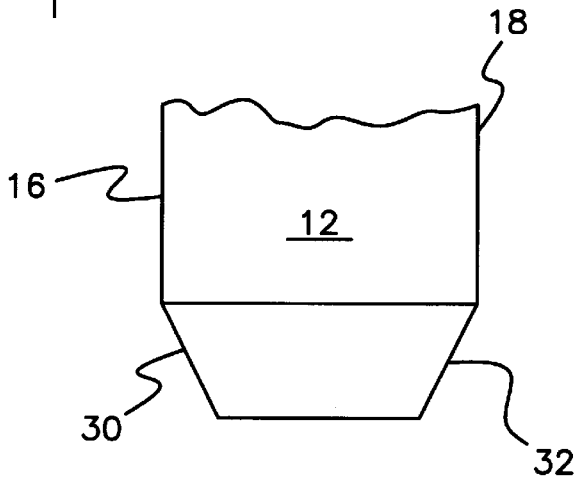
FIG. 4 is a front elevational, detail view of the lower end of the invention.

FIG. 4 illustrates an optional additional tapering of stabilizer 10. Tapered facets 30 and 32 formed in right and left lateral faces 16 and 18 further contribute to sharpness or pointed configuration of the lower end of stabilizer 10 for the purpose of expediting penetration of the ground when driving stabilizer 10 into the ground.

Discussion of locating stabilizer 10 in the ground thus far has assumed that stabilizer 10 is to be driven by pressure or by impacts. While driving may be performed, it is equally feasible to dig a hole (not shown) in the ground prior to installing rod 2 and stabilizer 10, then to place rod 2 and stabilizer 10 in the hole, back fill the hole, and tamp as required.

It is to be understood that the present invention is not limited to the embodiments described above, but encompasses any and all embodiments within the scope of the following claims.

I claim:

1. A stabilizer for stabilizing a rod driven into the ground and placed under tension from a guy wire, said stabilizer for opposing displacement of the rod when it is under tension from the guy wire, said stabilizer comprising:

a flattened elongate body having a generally smooth, flat front face, a rear face, a right lateral face, and a left lateral face and where said right and said left lateral faces are substantially narrower than both said front face and said rear face and where said front face and said rear face are generally parallel one another and where said right lateral side and said left lateral side are also generally parallel one another such that said flattened elongate body has a generally rectangular cross section;

said flattened elongate body also including a first end including a broadened head, said broadened head comprising a rectangular flange extending entirely from said front face, said flattened elongate body also including a second end, said second end comprising a tapered portion wherein said front face is disposed at an angle to said rear face such that the distance between said front face and said rear face is regularly decreased in the direction away from said first end, and where said second end also including a terminal surface, said terminal surface being substantially planar; and a longitudinal semicircular groove extending entirely along the length of said rear face, said semicircular groove having a constant depth in relation to said rear face along the entire length of said semicircular groove; whereby said stabilizer is adapted to be driven into the ground by striking said broadened head and said longitudinal semicircular groove is adapted to cooperate with the rod to maintain the rod in a desired position when the rod is placed under forces from the guide wire.

2. The stabilizer according to claim 1, wherein said flattened elongate body is made from recycled plastic material.

* * * * *